United States Patent [19]

Ebersold

[11] 3,931,698

[45] Jan. 13, 1976

[54] CENTER GUIDED CRANE BOOM

[75] Inventor: Robert C. Ebersold, Novelty, Ohio

[73] Assignee: The Warner & Swasey Company, Cleveland, Ohio

[22] Filed: Nov. 20, 1974

[21] Appl. No.: 525,356

[52] U.S. Cl. ..... 52/118; 212/55

[51] Int. Cl.[2] ..... E04H 12/18

[58] Field of Search ..... 52/115–121; 212/46 B, 55, 17, 144, 58 R; 343/901, 902

[56] References Cited

UNITED STATES PATENTS

| | | | |
|---|---|---|---|
| 3,102,742 | 9/1963 | Shurcliff | 52/118 X |
| 3,315,821 | 4/1967 | Grove | 212/55 |
| 3,478,894 | 11/1969 | Stauffer | 212/55 |
| 3,738,075 | 6/1973 | Nansel | 52/118 X |

*Primary Examiner*—J. Karl Bell

*Attorney, Agent, or Firm*—Alfred L. Patmore; T. Thomas Von Pechy

[57] ABSTRACT

An improved crane boom structure for telescopic boom sections. The conventional, generally rectangular cross-sectional shape is modified to provide central guiding of the boom sections to locate the bearing forces transmitted between sections at or near the neutral axis where bending stresses are minimal for greater load carrying capacity for a given boom weight. The boom side walls are provided with channel shaped projections, the top and bottom channel legs being located on either side of the neutral axis of the beam section, preferably symmetrical therewith. Bearing surfaces are interposed between top and bottom channel legs of contiguous boom sections.

14 Claims, 5 Drawing Figures

CENTER GUIDED CRANE BOOM

BACKGROUND OF THE INVENTION

1. Field of the Invention

Telescoping crane booms and particularly those mounted on mobile carriers require the efficient use of a minimum of material, i.e. structural steel, to resist the deflection and stresses imposed on the boom by lifting the required loads. The box section or rectangular cross-section boom, which is universally used, is an efficient structure to resist the bending loads, the major strength in the box section being obtained from the material or thickness in the top and bottom sections. Telescoping cranes consist of a number of similar sections nested together, usually between two and five sections, and a smaller section is extensible and retractible within the next larger section. When telescoped in or out, the boom sections support each other with sliding pads, shoes or rollers interposed between the sections. The maximum deflection and stress in the boom sections and the maximum load imposed on the bearing points between sections occur when the sections are telescoped out their maximum distance. The top and bottom members of the box section boom construction are highly stressed, the top in tension and the bottom in compression, due to bending from the overhanging load, and, in addition, these members are subject to high local loading at the bearing supports. The present invention contemplates a more efficient boom section for carrying higher loads by locating the bearing points as close as possible to the neutral axis of the boom. In doing so, the load bearing supports will be located where the bending stresses are at or near a minimum, and the top and bottom members of the boom sections will be relieved of the local high bearing loading and hence can be sized to carry the tension and compression stresses, respectively, due to bending.

2. Description of the Prior Art

In order to provide for free guided relative longitudinal movement between adjacent sections of the boom structure, normally a pair of bearing surfaces are provided on the first inner section, on its top side adjacent the rear end thereof for contact with under side of the top wall of the largest or base section. Likewise, a pair of bearing surfaces are normally provided on the forward or outer end of the base section for contact with the underside of the bottom wall of the first inner section. This alternating positioning of bearing surfaces is used for additional boom sections as will be more fully explained in connection with the present invention. An example of this arrangement using stationary and pivotally mounted bearing pads is shown in Johnston et al. U.S. Pat. No. 3,368,696. The use of rollers as bearings between sections is typically shown in Obenchain U.S. Pat. No. 2,819,803 and Grove U.S. Pat. No. 3,386,594. An articulated bearing assembly utilizing a pair of pivotally mounted slider blocks or shoes is shown in Benkowski U.S. Pat. No. 3,782,790. Examples of modifying the rectangular or box-shaped cross-section to obtain greater load carrying capacity are shown in Sterner U.S. Pat. No. 3,708,937 and Johnston U.S. Pat. No. 3,807,108 which utilize trapezoidal cross-sections. A beveled box section is shown in Eiler U.S. Pat. No. 3,481,490. There is no suggestion in any of these prior art structures of locating the bearing surfaces at or close to the neutral axis of the boom cross-section.

SUMMARY OF THE INVENTION

In accordance with the present invention a mobile crane is provided with a plurality of telescopic boom sections. The embodiment of FIG. 2 shows a four section boom and FIG. 4 shows a three-section boom, with two to five sections being common in the art.

One of the primary objectives of the present invention is the location of the bearing pads between contiguous sections at a point where normal bending stresses are near a minimum. In the normal rectangular crane boom section, the bending stresses due to the beam weight and overhanging load are at maximum in the top and bottom plates, and the minimum stresses are at the neutral axis of the beam which is at the geometrical horizontal centerline. In the instant invention, the boom side walls are provided with channel shaped projections located symmetrically with respect to the horizontal neutral or geometric axis of the section. This places the channel legs in horizontal planes equidistant from the horizontal geometric axis. Adjacent boom sections have complementary channel projections nested together so that bearing surfaces can be placed between adjacent top and bottom channel legs. In the embodiment of FIG. 2 which nominally shows a four section boom, all of the channel shaped projections face outwardly with the top bearing pads being affixed to the exterior surfaces of the channel legs to engage the inside surfaces of the channel legs of the next larger adjacent boom section. Similarly, the bottom bearing pads of the FIG. 2 embodiment are affixed to the interior surfaces of the channel legs to engage the exterior surfaces of the channel legs of the next smaller adjacent boom section.

In the embodiment of FIG. 5 which nominally shows a three-section boom, the intermediate or mid-section is formed with inwardly and outwardly projecting channel sections which are conveniently constructed with square tubing in each of the sidewalls. The largest or base section of the boom has outwardly projecting channel-shaped projections which nest with the outwardly projecting portion of the square tubing of the mid section, and the smallest or jib section of the boom has inwardly projecting channel-shaped projections which nest with the inwardly projecting portion of the square tubing of the mid section. Bearing means are placed between contiguous sections in a manner similar to the FIG. 2 embodiment, and in both embodiments the bearing means may take the form of rollers, rocker arms, or flat bearing plates.

The present invention has thus overcome the above disadvantage of locating the bearing surface at the points of maximum stress.

Another advantage of the present construction is that it permits the placement of intervening bearing pads of adjacent sections on the channel legs so as to be located directly in line with the vertical portions of the side walls to thus utilize the side walls in compression as columns. A good showing of the usual prior art structure wherein the bearing pads are not located directly in line with section side walls is shown in FIGS. 2 and 3 of Sung U.S. Pat. No. 3,690,742 which patent also shows the improvement that is obtained by locating the bearing pads in line with the side walls.

BRIEF DESCRIPTION OF THE DRAWINGS

Still other objects and advantages of this invention will become readily apparent from the following description and drawings setting forth the preferred embodiment of the invention wherein.

DESCRIPTION OF THE PREFERRED EMBODIMENT

Figure 1:
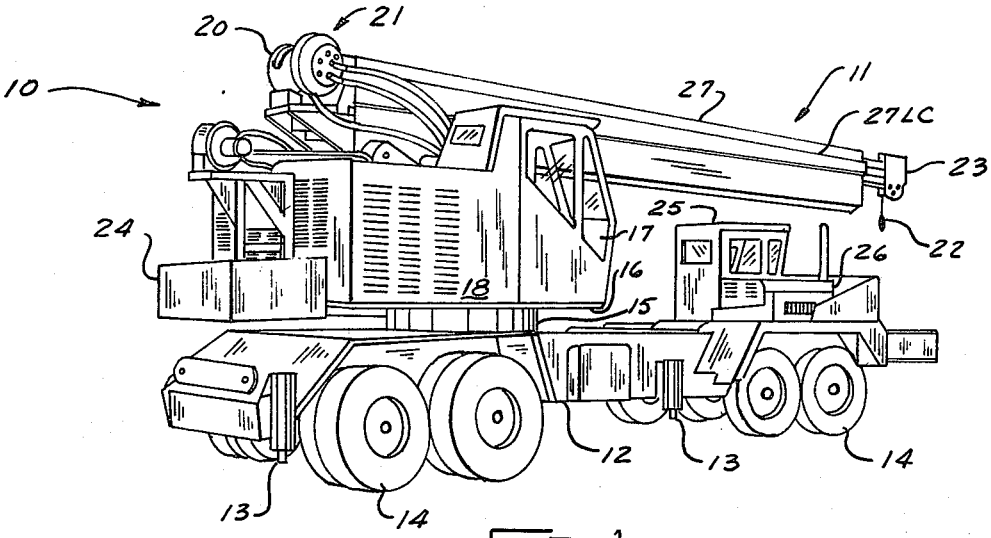
FIG. 1 is a perspective view of a mobile crane incorporating the boom structure of this invention and wherein the boom is illustrated in retracted transport position.

Referring to the drawings, there is illustrated in FIG. 1 a mobile crane vehicle 10 including the boom structure 11 of this invention. Mounted on frame 12 of vehicle 10 are hydraulically operated outriggers 13 located on both sides of vehicle 12. When the crane is to be operated the outriggers 13 are extended laterally outward from the frame 12 and then extended downwardly into engagement with the ground to remove part of the load from the vehicle frame 12 and wheels 14 and to cooperate with the vehicle wheels 14 to stabilize the vehicle frame 12 against vertical and lateral movements.

A turntable 15 carried at the rearward end of vehicle frame 12 rotatably supports a base frame 16 for 360° rotation in a horizontal plane relative to the vehicle frame 12. The boom structure 11 is pivotally mounted on the base frame 16 for raising and lowering the boom assembly by hydraulic cylinders not shown. Also mounted on the base frame 16 is an operator's cab 17 and a power plant 18 for supplying hydraulic power to motor 20 which forms part of the winch unit 21 which is mounted at the rear end of the boom structure for supplying lifting power to load lifting cable 22 operating through hammerhead or tackle block unit 23 at the forward end of boom structure 11. Additionally, power plant 18 supplies hydraulic power to hydraulic motors and cylinders (not shown) to rotate turntable 15, to raise and lower boom structure 11, to extend and retract the boom structure 11, and to extend and operate outriggers 13. Counterweight 24 is also attached to base frame 16 at its rearward end to counterbalance the overhanging weight of the boom structure 11 and the lifting load.

The mobile crane vehicle 10 is shown in FIG. 1 with its boom structure 11 in transport position, i.e. the boom assembly is fully retracted and extends horizontally and longitudinally over the vehicle frame 12. A driver's cab 25 and power unit 26 for driving the vehicle 10 are mounted on the front end of vehicle frame 12 below and in clearance relationship with the boom structure 11.

Figure 2:
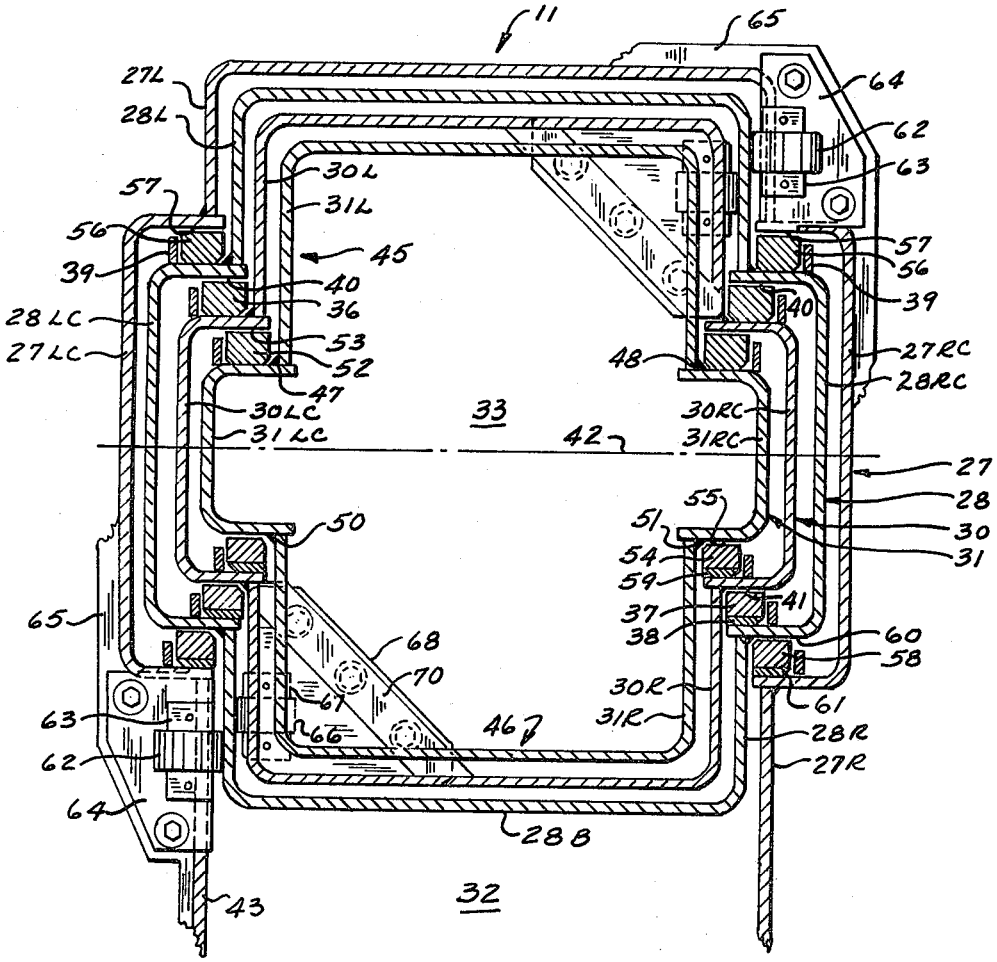
FIG. 2 is an enlarged sectional view of a four section boom structure showing the details of the center guiding bearing arrangement, with the lower portion of the base section broken away.
Figure 3:
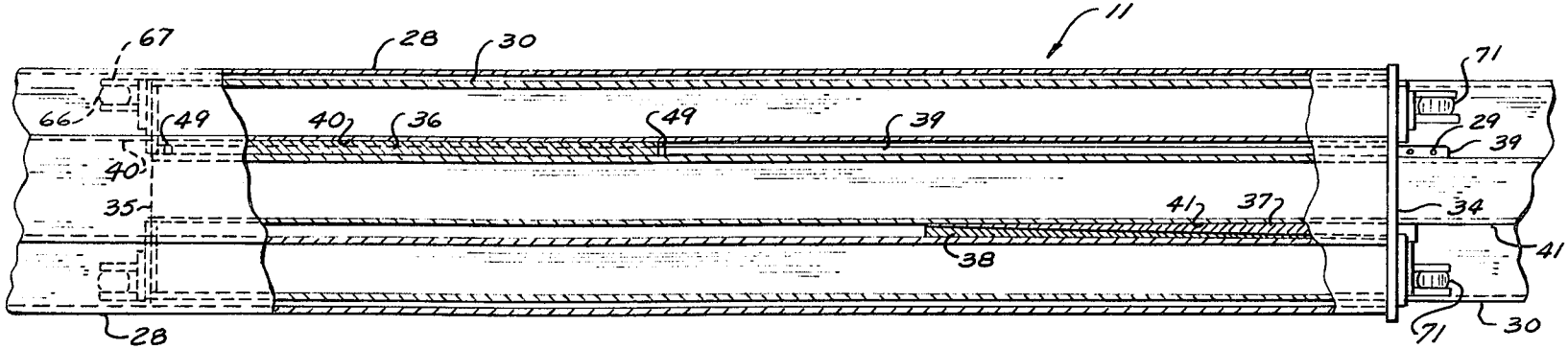
FIG. 3 is an enlarged longitudinal view, partially in section, of two boom sections in extended relationship to each other showing the gibs and bearings.

Referring to FIGS. 2 and 3 the boom assembly 11 is shown as comprised of four generally rectangular sections, namely the base section 27 which is closest to the base frame 16 to which it is pivotally mounted and which has the largest cross-section; the inner mid section 28 which is telescopically received in contiguous relationship with the base section 27; the outer mid section 30 which is telescopically received in contiguous relationship with the inner mid section 28, and the fly section 31 which has the smallest cross-section and is telescopically received in contiguous relationship with the outer mid section 30. As the inner mid section 28 is closer to the base frame 16 than the outer mid section 30 when the boom assembly 11 is extended, likewise, when reference is made to the inner or outer end of a particular section, it denotes the end of the section closest to and farthest from the base frame respectively. In this four-section boom structure, a hydraulic cylinder, not shown, would normally be located in the area 32 below the inner mid section 28 to extend and retract the inner mid section 28 with respect to the base section 27. In a like manner, two hydraulic cylinders, not shown, would be located in the area 33 bound by the fly section 31, one cylinder to extend and retract the outer mid section with respect to the inner mid section 28, and the other cylinder to extend and retract the fly section 31 with respect to the outer mid section 30. These cylinders and their piston rod connections have not been shown as they form no part of the present invention; they are well known and shown in the prior art cited above.

Referring to FIG. 3, the outer mid section 30 is shown in its extended position with respect to the inner mid section 28 within which the outer mid section 30 is telescopically received. The outer end of the inner mid section is designated by the numeral 34, and the inner end of the outer mid section is designated by the numeral 35. Upper bearing pads 36 are attached to the outer mid section 30 adjacent to its inner end 35, and lower bearing pads 37 are attached via gibs 38 to the inner mid section 28 adjacent to its outer end 34, the details of which will become more apparent from an examination of FIG. 2. The load imposed on the inner mid section by the weight of outer mid section, the weight of the fly section and the load carried by the load lifting cable is transmitted from the outer mid section to the inner mid section through bearing pads 36 and 37 to guide surfaces 40 and 41 respectively. As the outer mid section is retracted from its fully extended position shown in FIG. 3, bearing pads 36 will slide inwardly on guide surfaces 40 of inner mid section 28, and guide surfaces 41 of the outer mid section 30 will move inwardly on bearing pads 37.

Referring to FIG. 2, boom sections 28, 30, and 31 are symmetrical about horizontal centerline 42, which thus becomes the neutral axis of these beams for crane loading. Base section 27 is shown with an enlarged lower portion 43 which extends below the exterior of the bottom member 28B of inner mid section 28 a distance sufficient for area 32 to accomodate a hydraulic cylinder for extension and retraction of the inner mid section 28 with respect to base section 27. This determines a neutral axis of base section 27 below the neutral axis 42 of beam sections 28, 30, and 31. Since a primary object of this invention is the location of bearing forces as close to the neutral axis as practical, and since the bending stress creates upwardly and downwardly directed forces between contiguous boom sections, channel shaped projections from both sidewalls of each boom section which are located symmetrical or nearly symmetrical with the neutral axis of the sections accomplishes the desired result. Thus, fly section 31 is constructed with its sidewalls 31L and 31R having outwardly projecting channel members 31LC and 31RC respectively, each channel member being symmetric with neutral axis 42, i.e. the top and bottom legs of channel members 31LC and 31RC are vertically equidistant from neutral axis 42. The channel legs are perpendicular to the side walls while the channel webs are parallel to the side walls. Outer mid section 30 which contiguously surrounds fly section 31 is similarly constructed with its side walls 30L and 30R having outwardly projecting channel members 30LC and 30RC respectively, each channel member being symmetric with neutral axis 42. Inner mid section 28 which contiguously surrounds outer mid section 30 likewise is similarly constructed with channel members 28LC and 28RC. Finally, base section 27 which contiguously surrounds inner mid section 28 is similarly constructed except that its bottom wall 27B, not shown, is not immediately subjacent bottom 28B as explained above, and although channel members 27LC and 27RC are symmetric to neutral axis 42 of the other three boom sections, the neutral axis of the base section 27 is slightly below axis 42. Each of the four boom sections can be constructed from four channel members using four continuous longitudinal, exterior welds. For example, fly section 31 can be constructed with top channel 45 welded at the ends of its channel legs to the upper exterior leg ends of channel members 31LC and 31RC as shown at 47 and 48 respectively, and bottom channel 46 welded at the ends of its channel legs to the lower exterior leg ends of channel member 31LC and 31RC as shown at 50 and 51 respectively. Base section 27, inner mid section 28, and outer mid section 30 can be similarly constructed. This method of construction locates all of the welds near the neutral axis, the point of minimum stress. The top channel 45 can be specifically designed for the tension bending stress, and the bottom channel can be designed for the compression bending stress. An optimal boom weight to load carrying capacity can thus be achieved. Each of the sections 27, 28, 39, and 31 is so sized as to allow sufficient space between adjacent channel leg members to interpose a bearing surface for slideable engagement therebetween. The bearing surface is affixed to one of the adjacent leg members while the other adjacent leg member serves as a guide upon which the bearing surface contiguously rides.

While the bearing surface can take the form of rollers as in the aforesaid Obenchain U.S. Pat. No. 2,819,803 or shoes as in the aforesaid Benkowski U.S. Pat. No. 3,782,790 the structure of the instant invention is particularly well adapted to utilize a flat plate or pad type of bearing. This pad type of bearing can be made relatively long as shown in FIG. 3 with upper bearing pads 36 and lower bearing pads 37 to thereby better distribute the loading lengthwise. Additionally, the pad type of bearing can be made to be adjustable for wear as in the machine tool industry as shown by the use of gibs 38 below the lower bearing pads 37. The bearing pads having a tapered bottom surface need only be shifted longitudinally with respect to the gib which has a correspondingly tapered top surface to make an initial adjustment or a subsequent adjustment for wear. The present structure also contemplates the easy removal of the upper bearing pads which are located at the inner ends of the boom sections without completely disassembling the sections from each other. In the fully extended position shown in FIG. 3, screws 29 in bearing holder 39 are accessible and can be removed. Bearing holders 39 extend in front of and beyond the inner ends of bearing pads 36, with ears 49 on either end of the bearing pad. The holder 39 and bearing 36 can thus be easily removed.

Figure 4:
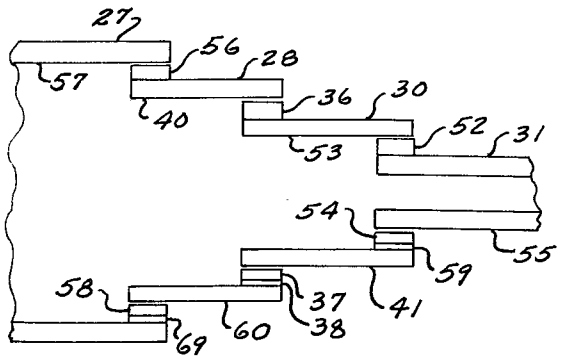
FIG. 4 is a longitudinal diagrammatic view of the channel portions of the four section boom structure of FIG. 2 showing the relative placement of the bearing pads and guide surfaces.

As seen in FIGS. 2 and 4, the bearing pad location with respect to its corresponding guide surface can be readily ascertained. Fly section 31 has bearing pads 52 located at the inner exterior ends of the top legs of channel members 31LC and 31RC which slidingly engage guide surfaces 53 formed by the inside top legs of channel members 30LC and 30RC of outer mid section 30. The outer mid section 30 has bearing pads 54 located at the outer interior ends of the bottom legs of channel members 30LC and 30RC which slidingly engage the guide surfaces 55 formed on the exterior of bottom legs of channel members 31LC and 31RC of fly section 31. Bearing pads 54 are made adjustable by gibs 59. Outer mid section 30 also has bearing pads 36 located at the inner exterior ends of top legs of channel members 30LC and 30RC which slidingly engage guide surfaces 40 formed by the inside top legs of channel members 28LC and 28RC of inner mid section 28. The inner mid section 28 has bearing pads 37 located at the outer interior ends of the bottom legs of channel members 28LC and 28RC which slidingly engage the guide surfaces 41 formed on the exterior of bottom legs of channel members 30LC and 30RC of outer mid section 30. Bearing pads 37 are made adjustable by gibs 38. Inner mid section 28 also has bearing pads 56 located at the inner exterior ends of top legs of channel members 28LC and 28RC which slidingly engage guide surfaces 57 formed by the inside top legs of channel members 27LC and 27RC of base section 27. Finally, base section 27 has bearing pads 58 located at the outer interior ends of bottom legs of channel members 27LC and 27RC which slidingly engage the guide surfaces 60 formed on the outside of bottom legs of channel members 28LC and 28RC of inner mid section 28. With the aforesaid location of the bearing pads and the cooperating guide surfaces between the legs of adjacent channel members it can be seen that the bearing pads are located directly in line with the vertical portions of the sidewalls to thus utilize the sidewalls in compression as columns.

In order to provide lateral positioning between boom sections and to facilitate extension and retraction of the sections with a minimum of frictional resistance, rollers are provided at all four boom corners, mounted to the ends of the boom sections for rolling contact with the next adjacent boom side walls. These rollers are mounted projecting from the inner and outer ends of the boom sections. Typical mounting of these rollers can be seen in FIG. 2 in which rollers 62 are journalled on holders 63 affixed to brackets 64 mounted to flange 65 at the outer end of base section 27. Only two rollers 62 and their mountings are shown for the sake of clarity, but it should be understood that two additional rollers are mounted, one of the upper left corner and the other on the lower right hand corner of base section 27 as it would be viewed in FIG. 2. Rollers 62 are directed inwardly from base section 27 to roll against the exterior of sidewalls 28L and 28R to thereby guide the extension and retraction of inner mid section 28 with respect to base section 27. Rollers 66 are typical of rollers mounted on the inner end of a boom section. Rollers 66 are journalled in holders 67, affixed to brackets 68, mounted to cross member 70, and welded to the inner end 35 of the outer mid section 30. Only two rollers 66 are shown in FIG. 2, but, like rollers 62, four, one at each corner, are utilized. Rollers 66 are directed outwardly from the outer mid section 30 to roll against side walls 28L and 28R of the inner mid section 28 to thereby guide the extension and retraction of the outer mid section 30 with respect to the inner mid section 28. FIG. 3 shows the longitudinal location of these rollers 66 and also rollers 71 which are located at the outer end 34 of the inner mid section 28. Rollers 71 are directed inwardly from the inner mid section 28 to roll against the interior of the side walls of outer mid section 30. The use of rollers as opposed to pads for the lateral positioning provides a convenient method of assembly of the boom sections within each other by laying the sections on their sides and rolling them into each other. The gibs can also be adjusted in this position to properly align the bearing pads.

Figure 5:
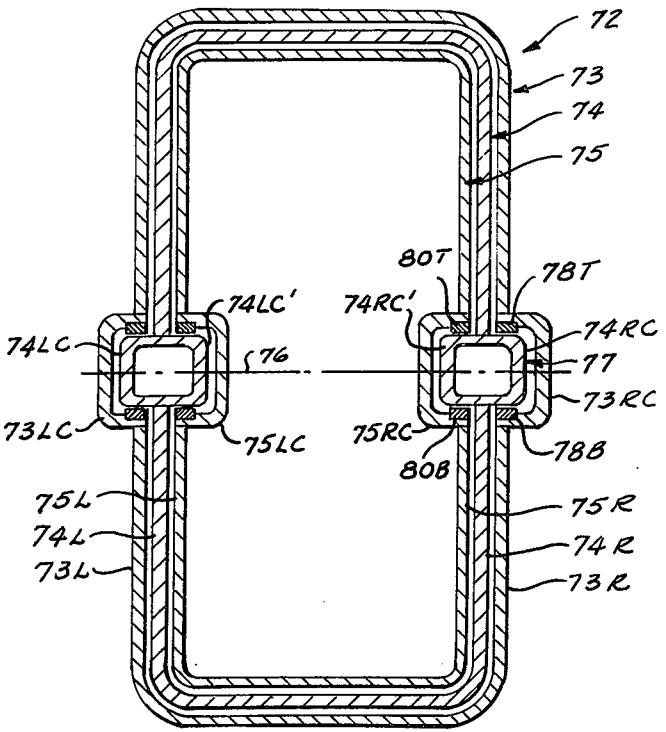
FIG. 5 is a view similar to FIG. 2 showing a modification particularly adapted for three section booms.

Referring to FIG. 5, an alternative crane boom structure is shown which is particularly adapted for three section booms. Boom assembly 72 is shown as comprised of three generally rectangular sections, namely the base section 73, which is closest to the base frame to which it is pivotally mounted and which has the largest cross-section, the mid section 74 which is telescopically received in contiguous relationship with the base section 73, and the fly section 75 which has the smallest cross-section and is telescopically received in contiguous relationship with the mid section 74. All three sections are symmetrical about horizontal centerline 76, which thus becomes the neutral axis of these beams for crane loading. Mid section 74 is constructed with its side walls 74L and 74R having square or rectangular tubing 77 located therein symmetric with neutral axis 76. Square tubing 77 creates in side walls 74L and 74R outwardly projecting channel members 74LC and 74RC respectively and also inwardly projecting channel members 74LC' and 74RC'. Base section 73 which contiguously surrounds mid section 74 is constructed with side walls 73L and 73R having outwardly projecting channel members 73LC and 73RC respectively which are complementary to mid section channel members 74LC and 74RC. Fly section 75 which is contiguously surrounded by mid section 74 is constructed with side walls 75L and 75R having inwardly projecting channel members 75LC and 75RC which are complementary to mid section channel members 74LC' and 74RC'. Each of the sections 73, 74, and 75 is so sized as to allow sufficient space between adjacent channel leg members to interpose a bearing surface for slideable engagement therebetween. Bearing pads 78T and 78B are interposed between base section 73 and mid section 74. Bearing pads 80T and 80B are interposed between the fly section and the mid section. The details of the bearing pad placement with the corresponding guide surfaces is the same as that for FIGS. 2–4 except for the fact that there is one less boom section in the modification of FIG. 5.

The basic difference between the boom assembly 72 and the boom assembly 11 which is created by the use of square tubing 77 in the side walls of mid section 74 to form inwardly and outwardly projecting channels is that bearing pads 78T and 80T are in the same horizontal plane above the neutral axis 76 and bearing pads 78B and 80B are in the same horizontal plane below the neutral axis 76. This puts all of the bearing and guiding surfaces closer to the neutral axis than is possible with the species of FIGS. 2–4. Also greater rigidity of the mid section side wall is obtained with the use of square tubing 77 which the column loads of the side walls from the fly section to the base section. It should be understood that while it is desirable in either case to locate the channel shaped projections with the channel legs symmetric with the neutral axis of the boom section, this is not always practical. Normally, however, the channel shape projections would be located on either side of the horizontal neutral axis. Likewise, the projections may not always be channel shaped. For example, with a two section boom, the projection could be flat plates.

Comparing both of the preferred species of the invention with rectangular beam sections having bearing between top and bottom members, the smaller guide section formed by the projecting channel members are less subject to dimensional variation enabling closer and more accurate guiding movement. Likewise, with the center-guided boom structure of the instant invention as compared with top and bottom wall guiding, the dimensions of the hammerhead can be decreased, decreasing the moment load when the boom assembly is operated at an angle to the horizontal. It should also be noted that the structure of the present invention by utilizing channels in the side wall has a greater resistance to buckling than the straight side walls of the conventional rectangular beam section.

Having described specific preferred embodiments of the invention the following is claimed:

1. An extensible boom assembly comprising, in combination a base section, at least one additional extensible and retractible boom section telescopically received in said base section, the sections of the extensible boom assembly having a generally rectangular transverse cross section including top, bottom and side walls, said side walls having projections, said projections of contiguous boom sections being complementary to one another, and bearing means having a load bearing surface interposed between contiguous projections.

2. An extensible boom assembly comprising, in combination a base section, at least one additional extensible and retractible boom section telescopically received in said base section, the sections of the extensible boom assembly having a generally rectangular transverse cross section including top, bottom and side walls, said side walls having channel shaped projecting portions with top and bottom channel legs located on either side of the horizontal neutral axis of said boom section, and said channel shaped projecting portions of contiguous boom sections being complementary to one another, and bearing means having a load bearing surface interposed between contiguous top and bottom channel legs.

3. The boom assembly of claim 2 wherein the top and bottom legs of the channel shaped projecting portions are located symmetric with the horizontal neutral axis.

4. The boom assembly of claim 2 wherein the channel shaped portions of the side walls project outwardly.

5. The boom assembly of claim 2 having at least three boom sections comprising a base section, a mid section telescopically received within said base section, a fly section telescopically received with said mid section, and wherein said mid section is constructed with rectangular tubing in each side wall forming inwardly and outwardly projecting channel portions, the side walls of the base section have outwardly projecting channel portions complementary with the outwardly projecting channel portions of said mid section side walls, and the side walls of the fly section have inwardly projecting channel portions complementary with the inwardly projecting channel portions of said mid section side walls.

6. The boom assembly of claim 5 wherein the tubing in each side wall is square tubing.

7. The boom assembly of claim 2 wherein the bearing means are bearing pads which are attached to one of the two contiguous channel legs for sliding engagement with the other contiguous channel legs as a guide surface.

8. An extensible boom assembly comprising, in combination a base section, at least one additional extensible and retractible boom section telescopically received in said base section, the sections of the extensible boom assembly having a generally rectangular transverse cross-section including top, bottom, and side walls, said side walls having channel shaped projecting portions with top and bottom channel legs located on either side of the horizontal neutral axis of said boom section, and said channel shaped projecting portions of contiguous boom sections being complementary to one another, upper bearing pads affixed to the exterior surface of top channel legs to engage the inside surfaces of the channel legs of the next larger adjacent boom section as guide surfaces, and lower bearing pads affixed to the bottom interior channel legs to engage the exterior surfaces of the channel legs of the next smaller adjacent boom section as guide surfaces.

9. The boom assembly of claim 8 further comprising gibs located between said lower bearing pads and the bottom interior channel legs.

10. The boom assembly of claim 8 wherein said boom sections have inner and outer ends and the upper bearing pads are affixed to the inner end of at least one boom section and the lower bearing pads are affixed to the outer end of at least one other boom section.

11. An extensible boom assembly comprising, in combination a base section, a mid section telescopically received in contiguous relationship with said base section, a fly section telescopically received in contiguous relationship with said mid section each of said sections having inner and outer longitudinal ends and having a generally rectangular transverse cross-section including top, bottom and side walls, said wide walls having channel shaped projecting portions with top and bottom channel legs located on either side of the horizontal neutral axis of said sections, and said channel shaped projecting portions of contiguous boom sections being complementary to one another, a pair of lower bearing pads affixed to the outer interior bottom channel legs of said base section for sliding engagement with the exterior bottom channel legs of the mid section as guide surfaces, a pair of upper bearing pads affixed to the inner exterior top channel legs of said mid section for sliding engagement with the interior top channel legs of the base section as guide surfaces, a pair of lower bearing pads affixed to the outer interior bottom channel legs of said mid section for sliding engagement with the exterior bottom channel legs of said fly section as guide surfaces; and a pair of upper bearing pads affixed to the inner exterior top channel legs of said fly section for sliding engagement with the interior top channel legs of the mid section as guide surfaces.

12. The boom assembly according to claim 11 wherein said mid section is constructed with rectangular tubing in each side wall forming inwardly and outwardly projecting channel portions, the side wlls of the base section having outwardly projecting channel portions complementary with the outwardly projecting channel portions of said mid section side walls, and the side walls of the fly section have inwardly projecting channel portions complementary with the inwardly projecting channel portions of said mid section side walls.

13. The boom assembly of claim 11 wherein the channel shaped portions of the side walls project outwardly.

14. The boom assembly of claim 11 further comprising rollers mounted on the four corner ends of the boom sections for rolling contact with the next adjacent boom side walls.

* * * * *